US007098852B2

(12) United States Patent
Ikuta et al.

(10) Patent No.: US 7,098,852 B2
(45) Date of Patent: Aug. 29, 2006

(54) ANTENNA, ANTENNA MODULE AND RADIO COMMUNICATION APPARATUS PROVIDED WITH THE SAME

(75) Inventors: Takanori Ikuta, Kyoto (JP); Akinori Sato, Kyoto (JP)

(73) Assignee: Kyocera Corporation, Kyoto (JP)

( * ) Notice: Subject to any disclaimer, the term of this patent is extended or adjusted under 35 U.S.C. 154(b) by 60 days.

(21) Appl. No.: 10/876,946

(22) Filed: Jun. 24, 2004

(65) Prior Publication Data

US 2005/0001770 A1 Jan. 6, 2005

(30) Foreign Application Priority Data

Jun. 24, 2003 (JP) ..... 2003-180230

(51) Int. Cl.
*H01Q 1/38* (2006.01)

(52) U.S. Cl. ..... 343/700 MS; 343/846

(58) Field of Classification Search ..... 343/700 MS, 343/702, 895, 846, 848
See application file for complete search history.

(56) References Cited

U.S. PATENT DOCUMENTS

| | | | | |
|---|---|---|---|---|
| 5,828,340 | A | 10/1998 | Johnson | 343/700 MS |
| 6,801,169 | B1 * | 10/2004 | Chang et al. | 343/700 MS |
| 2004/0001029 | A1 * | 1/2004 | Parsche et al. | 343/866 |
| 2004/0189528 | A1 * | 9/2004 | Killen et al. | 343/700 MS |

* cited by examiner

*Primary Examiner*—Hoang V. Nguyen
*Assistant Examiner*—Huedung X. Cao
(74) *Attorney, Agent, or Firm*—Hogan & Hartson LLP

(57) ABSTRACT

An antenna is structured in a manner that a rectangular radiation electrode, a ground electrode opposed in parallel to a long side and a short side adjacent to each other of the radiation electrode, respectively, and a feeder electrode connected to the long side of the radiation electrode are formed on a substrate. A portion opposed to the long side of the ground electrode has a length not more than the long side and a width equal to or less than a length of the short side, and a portion opposed to the short side of the ground electrode has a length more than the short side and a width equal to or more than a length of the long side.

13 Claims, 4 Drawing Sheets

ANTENNA, ANTENNA MODULE AND RADIO COMMUNICATION APPARATUS PROVIDED WITH THE SAME

BACKGROUND OF THE INVENTION

1. Field of the Invention

The present invention relates to an antenna and an antenna module which are used in a radio communication apparatus such as a radio LAN (Local Area Network) and mobile communications, and also relates to a radio communication apparatus provided with the same.

2. Description of the Related Art

A radio communication apparatus such as a radio LAN and mobile communications in recent years has been rapidly made to be small-sized, light-weight, high-performance and capable of high-speed data communication, and an antenna serving as one of the components of the radio communication apparatus has been also strongly desired to be small-sized, high-performance and ready for a wide band.

Among communication systems using the radio communication apparatuses, a wide-band communication system is in the limelight, expected to be usable for an ultrahigh-speed radio communication system in the future, because Federal Communications Commission (abbreviated as FCC) approved general use thereof. In the wide-band communication system, wide-band signals of a very wide frequency band such that used frequencies range from 3.1 GHz to 10.6 GHz are used, and a horn antenna, a discone antenna and the like are thought to be usable in general as the antenna used in the radio communication apparatus in point of wideness of the band and highness of gain.

However, the horn antenna and the discone antenna are of large outer sizes, and on the price side, it is difficult to lower the prices thereof, so that there is a problem such that the antennas become hard to apply to a mobile information terminal or the like, which is a radio communication apparatus for general use.

As opposed to the above, it was proposed to use a monopole antenna in which a radiation electrode having a plate-like shape is opposed to a ground electrode at a taper angle and make the antenna ready for wide-band signals (refer to U.S. Pat. No. 5,828,340, for example).

However, in the case of forming the radiation electrode at a taper angle with the ground electrode in the monopole antenna, the setting of the angle and the setting of the size of the radiation electrode subtly affect radiation characteristics, so that there is a problem such that it is difficult to obtain a stable antenna characteristic.

SUMMARY OF THE INVENTION

The invention was devised in order to solve the problems in the prior arts as described above, and an object thereof is to provide an antenna and an antenna module which are capable of easily and stably exhibiting excellent antenna characteristics to wide-band signals, which achieve a high radiation efficiency, which are small-sized and inexpensive, and which are sufficiently applicable to a mobile information terminal or the like serving as a radio communication apparatus for general use, and provide a radio communication apparatus provided with the same.

Further, an object of the invention is to provide an antenna and an antenna module which are capable of excellent radio communication in a very wide frequency band in which used frequencies range from 3.1 GHz to 10.6 GHz of a wide-band communication system, and provide a radio communication apparatus using the same.

The invention provides an antenna comprising:

a substrate;

a radiation electrode having a rectangular shape formed on the substrate;

a ground electrode formed on the substrate and opposed in parallel to long and short sides adjacent to each other of the radiation electrode, respectively; and a feeder electrode formed on the substrate and connected to the long side of the radiation electrode, wherein a portion of the ground electrode opposed to the long side has a length not more than the long side and a width equal to or less than the length of the short side, and a portion of the ground electrode opposed to the short side has a length more than the short side and a width equal to or more than the length of the long side.

Further, in the invention, in the above structure, the radiation electrode is thicker than the ground electrode.

In the invention, the feeder electrode is placed in a manner that a front end thereof enters a notch portion formed in the midway of the portion of the ground electrode opposed to the long side.

In the invention, the substrate is made of a dielectric material and a relative dielectric constant thereof $\epsilon_r$ is in a range of 3 to 30.

In the invention, the substrate is made of a magnetic material and a relative permeability thereof $\mu_r$ is in a range of 1 to 8.

In the invention, an internal portion of the radiation electrode is made of a dielectric material and a relative dielectric constant thereof $\epsilon_r$ is in a range of 3 to 30.

In the invention, an internal portion of the radiation electrode is made of a magnetic material and a relative permeability thereof $\mu_r$ is in a range of 1 to 8.

Still further, the invention provides an antenna module comprising:

the antenna of the invention of any of the above structures; and an electronic component installed in a region corresponding to the length more than the short side or to the width equal to or more than the length of the long side in the portion opposed to the short side of the ground electrode of the antenna.

Still further, the invention provides a radio communication apparatus comprising:

the antenna of the invention of any of the above structures or the antenna module of the invention of the above structure; and at least one of a transmitting circuit and a receiving circuit connected thereto.

Still further, in the invention, in the above structure, wide-band signals in a range of 3.1 GHz to 10.6 GHz are used as radio signals.

According to the invention, the radiation electrode having a rectangular shape, the ground electrode opposed in parallel to the long side and the short side adjacent to each other of the radiation electrode, respectively, and the feeder electrode connected to the long side of the radiation electrode are formed on the substrate. The portion of the ground electrode opposed to the long side has a length not more than the long side and a width equal to or less than the length of the short side, and the portion of the ground electrode opposed to the short side has a length more than the short side and a width equal to or more than the length of the long side. Therefore, it is possible to make an amount of change in input impedance of the antenna in relation to a frequency to be small over a wide band, and it is possible by an unprecedented small-sized antenna to easily and stably obtain an excellent antenna characteristic to high-frequency and wide-band radio signals. Moreover, it is possible to obtain, at a low price, an antenna which is sufficiently applicable to a mobile information terminal or the like serving as a radio communication apparatus for general use.

Further, according to the invention, when the radiation electrode is made to be thicker than the ground electrode in the above structure, the capacity of the radiation electrode can be increased, and an excitation electric current to be excited can be increased as the electrical capacity of the antenna increases. Therefore, it is possible to increase a radiation efficiency, make the antenna to be ready for a wide band, and increase an antenna characteristic.

According to the invention, an effective length of the radiation electrode becomes long and a region of the high electric current density in electric current distribution increases, so that it is possible to increase an amount of radio waves radiated from the radiation electrode, and it is possible to increase gain of the antenna. Moreover, it is possible to miniaturize the antenna.

According to the invention, the impedance of the radiation electrode becomes large, so that it is possible to decrease the Q value of the antenna and widen the bandwidth.

Still further, according to the invention, an electronic component is installed in the region corresponding to the length more than the short side or the width equal to or more than the length of the long side in the portion of the ground electrode opposed to the short side in the antenna of the invention as described above. Therefore, the ground electrode can be effectively used, so that it is possible to form not only an antenna function but also a peripheral electric circuit function or the like, and it is possible to realize a small-sized and high-performance antenna module.

Still further, according to the invention, the antenna of the invention or the antenna module of the invention as described above and at least one of a transmitting circuit and a receiving circuit connected thereto are provided, so that a small-sized and high-performance radio communication apparatus having a radio communication function in addition to the antenna or the antenna module is realized.

Still further, according to the invention, particularly when used radio signals are wide-band signals in the range of 3.1 GHz to 10.6 GHz, a small-sized and high-performance radio communication apparatus in a radio communication system using wide-band signals so as to enable high-speed data communication such as a wide-band communication system is realized.

As mentioned above, according to the invention, it is possible to provide an antenna and an antenna module which are capable of easily and stably exhibiting an excellent antenna characteristic to wide-band signals, which achieve a high radiation efficiency, which are small-sized and inexpensive, and which are sufficiently applicable to a mobile information terminal or the like serving as a radio communication apparatus for general use, and provide a radio communication apparatus provided with the same. Moreover, it is possible to provide an antenna and an antenna module which are capable of excellent radio communication in a very wide frequency band in which used frequencies range from 3.1 GHz to 10.6 GHz of a wide-band communication system, and provide a radio communication apparatus using the same.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
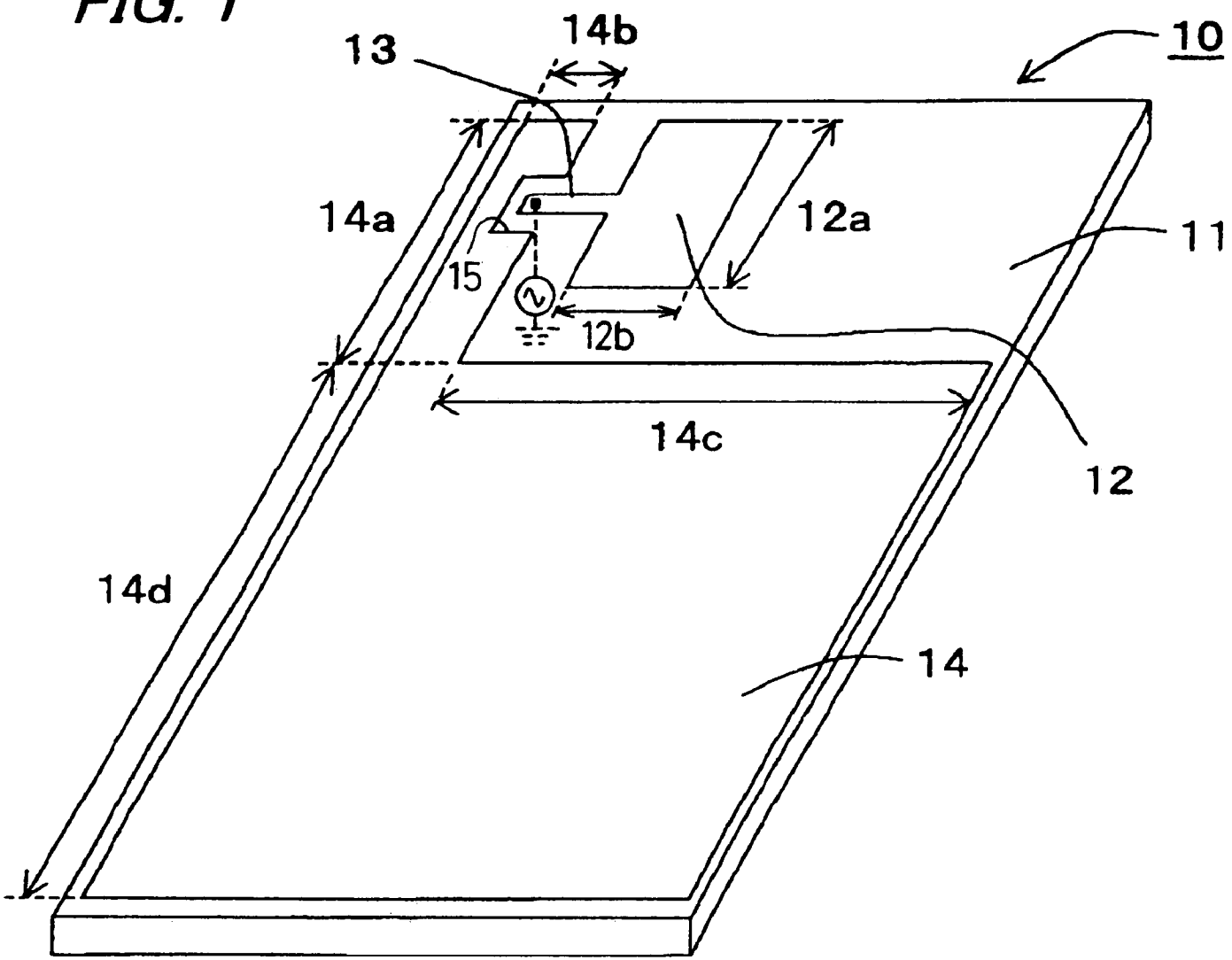
FIG. 1 is a perspective view showing an antenna according to an embodiment of the invention.

Now referring to the drawings, preferred embodiments of the invention are described below.

FIG. 1 is a perspective view showing an antenna according to an embodiment of the invention. In FIG. 1, an antenna 10 comprises a substrate 11, a radiation electrode 12, a ground electrode 14 and a feeder electrode 13. The substrate 11 is made of a dielectric material or a magnetic material. The radiation electrode 12 is formed on a surface of the substrate 11 and formed into a rectangular shape. Moreover, the ground electrode 14 is formed opposed in parallel to a long side and a short side adjacent to each other of the radiation electrode 12 on the substrate 11, respectively. The feeder electrode 13 is formed on the surface of the substrate 11 and connected to the long side of the radiation electrode 12 on the side opposed to the ground electrode 14. Then, of the ground electrode 14, a portion opposed to the long side of the radiation electrode 12 has a length not more than the long side of the radiation electrode 12 (that is, a front end of a dimension 14*a* in a direction parallel to the long side is not beyond the end of the long side of the radiation electrode 12 opposed thereto, namely, an end opposed to the end of the long side on the ground electrode 14 side) and a width equal to or less than the length of the short side of the radiation electrode 12 (that is, a dimension 14*b* in a direction orthogonal to the long side is equal to or less than a length 12*b* of the short side of the radiation electrode 12). Further, the ground electrode 14 has a portion opposed to the short side of the radiation electrode 12 having a length more than the short side (that is, a front end of a dimension 14*c* in a direction parallel to the short side is beyond the end of the short side of the radiation electrode 12 opposed thereto) and a width equal to or more than a dimension 12*a* of the long side of the radiation electrode 12 (a dimension 14*d* in a direction orthogonal to the short side is equal to or more than a length 12*a* of the long side of the radiation electrode 12).

According to an antenna 10 of the invention having such a structure, the radiation electrode 12 is formed opposed in parallel to the long side and the short side adjacent to each other of the ground electrode 14, respectively, so that it is possible to make an amount of change in input impedance of the antenna 10 in relation to a frequency to be small over a wide band. Therefore, it is possible to realize an antenna having an excellent antenna characteristic to wide-band signals, and it is possible to obtain a wide-band and high-gain antenna such as a horn antenna or a discone antenna used since before in small size and at a low price.

Then, according to the antenna 10 of the invention having such a structure, the radiation electrode 12 and the ground electrode 14 opposed in parallel to the long side and the short side adjacent to each other of the radiation electrode 12 are placed at a distance of, for example, approximately 0.5 mm to 10 mm from each other, and the feeder electrode 13 is connected to the long side of the radiation electrode 12 opposed to the ground electrode 14. Thereby the antenna 10 works as an antenna in which a frequency band has a wide bandwidth of, for example, from 3.1 GHz to 10.6 GHz.

The substrate 11 is made of a dielectric material or a magnetic material, and it is possible to use a general substrate such as a glass epoxy substrate, a ceramic substrate and a ferrite substrate, for example. Moreover, the substrate 11 may be a multilayer substrate when necessary, for example, for the purpose of increase of density and miniaturization.

In a case where the substrate 11 is made of a dielectric material, a propagation speed of high-frequency signals propagating in the radiation electrode 12 decreases, and a shortening effect of a wavelength occurs. Assuming the relative dielectric constant of the substrate 11 is $\epsilon_r$, an effective length of the radiation electrode 12 is increased by $\epsilon_r^{1/2}$ times. Therefore, in a case where the outer shape is common, a region of the high electric current density in electric current distribution in the radiation electrode 12 increases as the relative dielectric constant $\epsilon_r$ increases, so that it is possible to increase an amount of radio waves radiated from the radiation electrode 12, and it is possible to increase gain of the antenna 10.

Further, on the contrary, in the case of the same characteristic as the conventional antenna characteristic, it is possible to make the outer shape of the radiation electrode 12 to be $1/\epsilon_r^{1/2}$, and it is possible to miniaturize the antenna 10.

In a case where the substrate 11 is made of a dielectric material, when the relative dielectric constant $\epsilon_r$ is less than 3, it is close to the relative dielectric constant in the air ($\epsilon_r$=1). Accordingly, it is rather difficult to satisfy a market demand for miniaturization of the antenna. Moreover, when the relative dielectric constant $\epsilon_r$ is more than 30, miniaturization is possible, but the gain and bandwidth of the antenna become too small because the gain and bandwidth of the antenna are proportional to the size of the antenna, and a characteristic as an antenna may not be achieved. Therefore, in the case of producing the substrate 11 by a dielectric material, it is desirable to use a dielectric material whose relative dielectric constant $\epsilon_r$ is in a range of 3 to 30. Such a dielectric material is, for example, a ceramic material including alumina ceramics and zirconia ceramics, and a resin material including tetrafluoroethylene and glass epoxy.

On the other hand, in a case where the substrate 11 is made of a magnetic material, the impedance of the radiation electrode 12 becomes large, so that it is possible to decrease the Q value of the antenna and widen the bandwidth. In a case where the substrate 11 is made of a magnetic material, when the relative permeability $\mu_r$ is more than 8, the bandwidth of the antenna becomes wide, but the gain and bandwidth of the antenna become too small because the gain and bandwidth of the antenna are proportional to the size of the antenna, so that a characteristic as an antenna may not be achieved. Therefore, in the case of producing the substrate 11 by a magnetic material, it is desirable to use a magnetic material whose relative permeability $\mu_r$ is in a range of 1 to 8. Such a magnetic material is, for example, YIG (yttrium iron garnet), an Ni—Zr compound, and an Ni—Co—Fe compound.

Further, the radiation electrode 12, the feeder electrode 13 and the ground electrode 14 are made of an electrically conductive material such as metal and formed on the substrate 11, and as a metallic material, for example, copper, silver, gold and a metallic compound having an excellent electrical conductivity whose main component is copper, silver or gold can be used.

The radiation electrode 12 is formed on the substrate 11 as an electrode having a rectangular shape, and radiates or receives radio signals of a wide band. The radiation electrode 12 is capable of appropriate radiation and reception of wide-band signals whose frequencies range from 3.1 GHz to 10.6 GHz, and is formed into a rectangular shape, and it is preferable that of the radiation electrode 12, the length 12*b* in the short side direction is smaller than the length 12*a* in the long side direction (12*b*<12*a*). Moreover, each corner portion of the radiation electrode 12 may be chamfered as circumstances demand in a range that a characteristic such as a frequency bandwidth of the antenna 10 is not spoiled, for a process of forming the radiation electrode 12, and it is possible to effectively prevent trouble such that the radiation electrode 12 peels off from the substrate 11 by chamfering.

The radiation electrode 12 can be easily formed on the surface of the substrate 11 by a screen printing method, an etching method or the like. Moreover, by partially trimming the radiation electrode 12, it is possible to regulate the bandwidth and the antenna characteristic.

The feeder electrode 13 is formed on the substrate 11, and electrically connected to the long side of the radiation electrode 12 on the side opposed to the ground electrode 14, and transmits radio signals of a wide band. As to the shape and size of the feeder electrode 13, for the purpose of rendering compatible with the input impedance of the radiation electrode 12, it is good to form the feeder electrode 13 into a line shape and decide the line width on the basis of the thickness, dielectric constant or the like of the substrate 11 so that the feeder electrode 13 becomes an approximately 50 Ω-type signal line. Moreover, a connecting position to the radiation electrode 12 is set to the vicinity of the middle of the length 12*a* in the long side direction of the radiation electrode 12, and by adjusting the position to a position in which a necessary bandwidth can be ensured, it is possible to make the amount of change in relation to a frequency of the input impedance of the antenna 10 to be small over a wide band. As a result, radio signals of a wide band from 3.1 GHz to 10.6 GHz can be appropriately transmitted between the radiation electrode 12 and the transmitting circuit or the receiving circuit.

The ground electrode 14 is formed in close vicinity to the radiation electrode 12 on the substrate 11, opposed in parallel to the long side and the short side adjacent to each other of the radiation electrode 12, respectively, in a manner that the portion opposed to the long side of the radiation electrode 12 has a length not more than the long side of the radiation electrode 12 and the width 14*b* equal to or less than the length 12*c* of the short side of the radiation electrode 12 and the portion opposed to the short side of the radiation electrode 12 has a length more than the short side of the radiation electrode 12 and the width 14*d* equal to or more than the length 12*a* of the long side of the radiation electrode 12. By placing the ground electrode 14 opposed in parallel to the long side and the short side adjacent to each other of the radiation electrode 12, respectively, it is possible to make the amount of change in input impedance of the antenna 10 in relation to a frequency to be small over a wide band. As a result, it is possible to realize an antenna having an excellent antenna characteristic to wide-band signals, and it becomes possible to obtain a wide-band and high-gain antenna such as a horn antenna and a discone antenna used since before, in small size and at a low price.

Although there is no restriction on the shape and size of the ground electrode 14 as far as the above conditions are satisfied, since an excitation electric current flows in the ground electrode 14 as an antenna current is excited in the radiation electrode 12, it is possible to increase radiation electric power by setting the size of the ground electrode 14 so that the excitation currents flowing in the radiation electrode 12 and the ground electrode 14 intensify each other.

Further, of the ground electrode 14, the portion opposed to the long side of the radiation electrode 12 has a length not more than the long side of the radiation electrode 12 and the width 14*b* equal to or less than the length 12*b* of the short side of the radiation electrode 12, and the portion opposed to the short side of the radiation electrode 12 has a length more than the short side of the radiation electrode 12 and the width 14*d* equal to or more than the length 12*a* of the long side of the radiation electrode 12. Therefore, an appropriate capacity component is formed between the radiation electrode 12 and the ground electrode 14, it becomes possible to be ready for a bandwidth over a wide-band frequency, and consequently, it is possible to make the antenna 10 of the invention to be an antenna having an excellent antenna characteristic to wide-band signals.

In the embodiment shown in FIG. 1, the front end of the feeder electrode 13 is placed so as to enter the midway of the portion of the ground electrode 14 opposed to the long side of the radiation electrode 12, a notch portion 15 is formed in the portion of the ground electrode 14. The notch portion 15 is effective for miniaturization of a feeder circuit. Even when the notch portion 15 is disposed in this manner, there is no problem for the structure of the antenna 10 of the invention because the width 14*b* of the portion of the ground electrode 14 opposed to the long side of the radiation electrode 12 is equal to or less than the length 12*b* of the short side of the radiation electrode 12. Moreover, the front end of the feeder electrode 13 does not need to be always placed so as to enter the ground electrode 14, and may be drawn to a back side of the substrate 11 by the use of a through conductor such as a via conductor or a through hole conductor as circumstances demand. In this case, it becomes possible to miniaturize the feeder circuit.

As described above, by forming the radiation electrode 12 into a rectangular shape, and forming the ground electrode 14 having a specified shape and size opposed in parallel to the long side and the short side adjacent to each other of the radiation electrode 12, respectively, it becomes possible to obtain a wide-band antenna characteristic in a high-frequency band of, for example, from 3.1 GHz to 10.6 GHz, and the antenna 10 works as an antenna having an excellent antenna characteristic in a radio communication apparatus such as a radio LAN and a mobile communication terminal.

Figure 2:
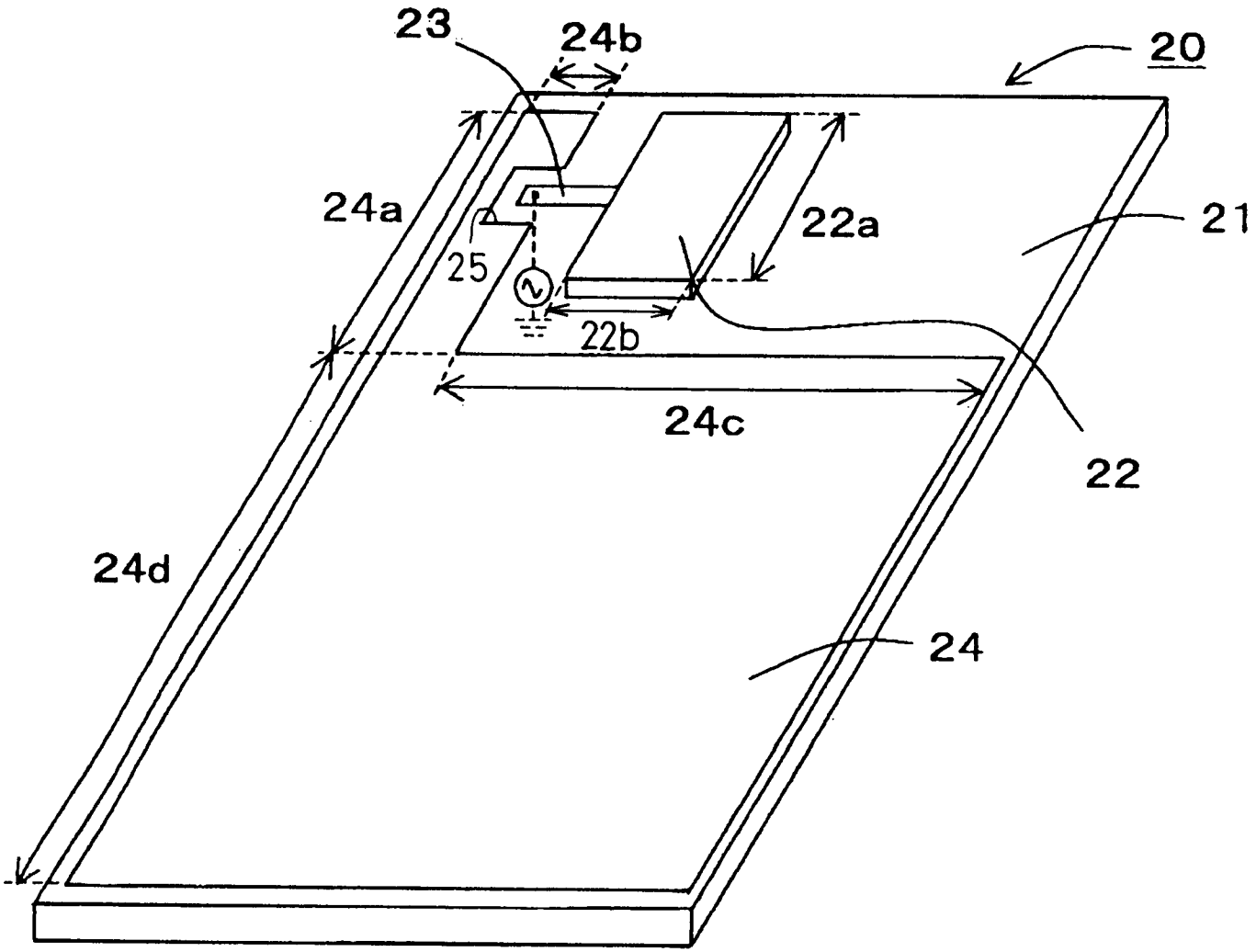
FIG. 2 is a perspective view showing an antenna according to another embodiment of the invention.

Next, FIG. 2 is a perspective view similar to FIG. 1, showing an antenna according to another embodiment of the invention.

In FIG. 2, an antenna 20 comprises a substrate 21, a radiation electrode 22, a feeder electrode 23, and a ground electrode 24. Moreover, reference numerals 22*a*, 22*b* denote a length of a long side and a length of a short side of the radiation electrode 22, respectively, reference numerals 24*a*, 24*b* denote a length and a width of a portion of the ground electrode 24 opposed to the long side of the radiation electrode 22, respectively, and reference numerals 24*c*, 24*d* denote a length and a width of a portion of the ground electrode 24 opposed to the short side of the radiation electrode 22, respectively. Although the substrate 21, the radiation electrode 22, the feeder electrode 23 and the ground electrode 24 are similar to the portions corresponding in FIG. 1, that is, the substrate 11, the radiation electrode 12, the feeder electrode 13 and the ground electrode 14, the radiation electrode 22 is made to be thicker than the ground electrode 24 and formed as an electrode having a shape of a rectangular parallelepiped in the embodiment shown in FIG. 2. In this case, as a result of increase of the capacity of the radiation electrode 22, an electrical volume as an antenna is increased, and an excitation electric current to be excited can be increased. Therefore, a high radiation efficiency can be obtained, and it becomes possible to make the antenna ready for a wide band and exhibit an excellent antenna characteristic.

Further, the radiation electrode 22 may be formed as a member independent from the substrate 21, and it is possible to take on a form of surface mounting by the use of a radiation electrode 22 formed as a conductor plate or a conductor block. In this case, it is possible to place the radiation electrode 22 on the substrate 21 by surface mounting by the use of, for example, a brazing material such as solder.

As the radiation electrode 22, a radiation electrode having a shape of a rectangular parallelepiped whose surface is made of metal or the like can be used, and as a metallic material, copper, silver, gold and a metallic compound having an excellent electrical conductivity whose main component is copper, silver or gold can be used, for example. Moreover, it is possible to form an internal portion of the radiation electrode 22 by the use of a dielectric material or a magnetic material instead of metal. In the case of using metal for the internal portion, it is possible to use, for example, copper, silver, gold or a metallic compound having an excellent electrical conductivity whose main component is copper, silver or gold, as a metallic material, as well as the surface.

In a case where a dielectric material is used for the internal portion of the radiation electrode 22, a propagation speed of high-frequency signals propagating in the radiation electrode 22 decreases, and a shortening effect of a wavelength occurs. Assuming the relative dielectric constant of the radiation electrode 22 is $\epsilon_r$, an effective length of the radiation electrode 22 is increased by $\epsilon_r^{1/2}$ times. Therefore, in a case where the outer shape is common, a region of the high electric current density in electric current distribution in the radiation electrode 22 increases as the relative dielectric constant increases, so that it is possible to increase an amount of radio waves radiated from the radiation electrode 22, and it is possible to increase gain of the antenna.

Further, on the contrary, in the case of the same characteristic as the conventional antenna characteristic, it is possible to make the outer shape of the radiation electrode 22 to be $1/\epsilon_r^{1/2}$, and it is possible to miniaturize the antenna 20.

In a case where the internal portion of the radiation electrode 22 is made of a dielectric material, when the relative dielectric constant $\epsilon_r$ is less than 3, it is close to the relative dielectric constant in the air ($\epsilon_r$=1). Accordingly, it is rather difficult to satisfy a market demand for miniaturization of the antenna. Moreover, when the relative dielectric constant $\epsilon_r$ is more than 30, miniaturization is possible, but the gain and bandwidth of the antenna become too small because the gain and bandwidth of the antenna are proportional to the size of the antenna, and a characteristic as an antenna may not be achieved. Therefore, in the case of producing the internal portion of the radiation electrode 22 by a dielectric material, it is desirable to use a dielectric material whose relative dielectric constant $\epsilon_r$ is in a range of 3 to 30. Such a dielectric material is, for example, a ceramic material including alumina ceramics and zirconia ceramics, and a resin material including tetrafluoroethylene and glass epoxy. For example, ceramics made by shaping and firing powder of a dielectric material whose main component is alumina can be used, and moreover, a composite material of ceramics and resin may be used.

On the other hand, in a case where the internal portion of the radiation electrode 22 is made of a magnetic material, the impedance of the radiation electrode 22 becomes large, so that it is possible to decrease the Q value of the antenna and widen the bandwidth.

In a case where the interior portion of the radiation electrode 22 is made of a magnetic material, when the relative permeability $\mu_r$ is more than 8, the bandwidth of the antenna becomes wide, but the gain and bandwidth of the antenna become too small because the gain and bandwidth of the antenna are proportional to the size of the antenna, and a characteristic as an antenna may not be achieved. Therefore, in the case of producing the interior portion of the radiation electrode 22 by a magnetic material, it is desirable to use a magnetic material whose relative permeability $\mu_r$ is in a range of 1 to 8. Such a magnetic material is, for example, YIG (yttrium iron garnet), an Ni—Zr compound, and an Ni—Co—Fe compound. Moreover, it is possible to use a magnetic material such as ferrite.

In the embodiment shown in FIG. 2, as the same shown in FIG. 1, the front end of the feeder electrode 23 is placed so as to enter the midway of the portion of the ground electrode 24 opposed to the long side of the radiation electrode 22, a notch portion 25 is formed in the portion of the ground electrode 24. The notch portion 25 is effective for miniaturization of a feeder circuit. Even when the notch portion 25 is disposed in this manner, there is no problem for the structure of the antenna 20 of the invention because the width 24*b* of the portion of the ground electrode 24 opposed to the long side of the radiation electrode 22 is equal to or less than the length 22*b* of the short side of the radiation electrode 22. Moreover, the front end of the feeder electrode 23 does not need to be always placed so as to enter the ground electrode 24, and may be drawn to a back side of the substrate 21 by the use of a through conductor such as a via conductor or a through hole conductor as circumstances demand. In this case, it becomes possible to miniaturize the feeder circuit.

According to the antenna 20 of the invention, a distance between the radiation electrode 22 and the ground electrode 24 opposed in parallel to the long side and the short side adjacent to each other, respectively, is set to, for example, approximately 0.5 mm to 10 mm, and the feeder electrode 23 is connected to the long side of the radiation electrode 22 opposed to the ground electrode 24. Thereby the antenna works as an antenna whose frequency bandwidth has a bandwidth of from 3.1 GHz to 10.6 GHz.

Furthermore, an antenna module of the invention (not shown) is structured in a manner that a conductor wiring circuit is formed as circumstances demand on a surface of a region having a length more than the short side or on a surface of a region having a width equal to or more than the length 12*a*, 22*a* of the long side of the radiation electrode 12, 22, of the portion opposed to the short side of the radiation electrode 12, 22 of the ground electrode 14, 24 formed on the substrate 11, 21 of the antenna 10, 20 of the invention as described above, and also on the back side of the substrate 11, 21 when desired, and electronic components including a semiconductor device, a capacitor and an inductor are installed and electrically connected.

According to the antenna module of the invention, it is possible to effectively use the ground electrode 14, 24, so that it is possible to structure a peripheral electric circuit function in addition to the antenna function, and a small-sized and high-performance antenna module is realized.

Further, a radio communication apparatus of the invention (not shown in the drawings) is provided with the antenna 10, 20 of the invention or the antenna module of the invention as described above, and at least one of a transmitting circuit and a receiving circuit connected thereto. Moreover, a radio signal processing circuit may be connected to the antenna, the antenna module, the transmitting circuit and the receiving circuit so as to enable radio communication when desired, and besides, various structures can be adopted.

According to the radio communication apparatus of the invention, the antenna 10 or 20 of the invention or the antenna module of the invention as described above, and at least one of the transmitting circuit and the receiving circuit connected thereto are provided, a small-sized and high-performance radio communication apparatus which has a radio communication function in addition to the antenna or the antenna module is realized.

Further, according to the radio communication apparatus of the invention, particularly when used radio signals are wide-band signals in the range of 3.1 GHz to 10.6 GHz, a small-sized and high-performance radio communication apparatus in a radio communication system using wide-band signals so as to enable high-speed data communication such as a wide-band communication system is realized.

Next, examples of an antenna of the invention will be described.

At first, the antenna 10 of the invention shown in FIG. 1 was manufactured by way of trial. A glass epoxy substrate of 0.8 mm in thickness was used for the substrate 11. The ground electrode 14 was formed in a manner that a horizontal width was 30 mm, a length was 50 mm and thickness was 0.02 mm. A portion opposed in parallel to the long side and the short side adjacent to each other of the radiation electrode 12 and a portion of the ground electrode 14 where the front end of the feeder electrode 13 was placed so as to enter were processed in accordance with the shape shown in FIG. 1. The radiation electrode 12 was formed into a rectangular shape by the use of copper foil such that the length 12*a* of the long side was 7 mm, the length 12*b* of the short side was 5 mm and thickness was 0.02 mm. Moreover, distances between the adjacent long side and short side of the radiation electrode 12 and the ground electrode 14 opposed in parallel thereto were set to 2 mm, respectively. Here, by changing and adjusting the distances between the adjacent long side and short side of the radiation electrode 12 and the ground electrode 14 opposed in parallel thereto as circumstances demand, for example, depending on the outer dimension of the ground electrode 14 and the outer dimension of the radiation electrode 12, it is possible to secure a desired bandwidth. Then, the feeder electrode 13 was connected to the midway of the long side of the radiation electrode 12 opposed to the ground electrode 14, whereby the antenna 10 of the invention was obtained.

Figure 3:
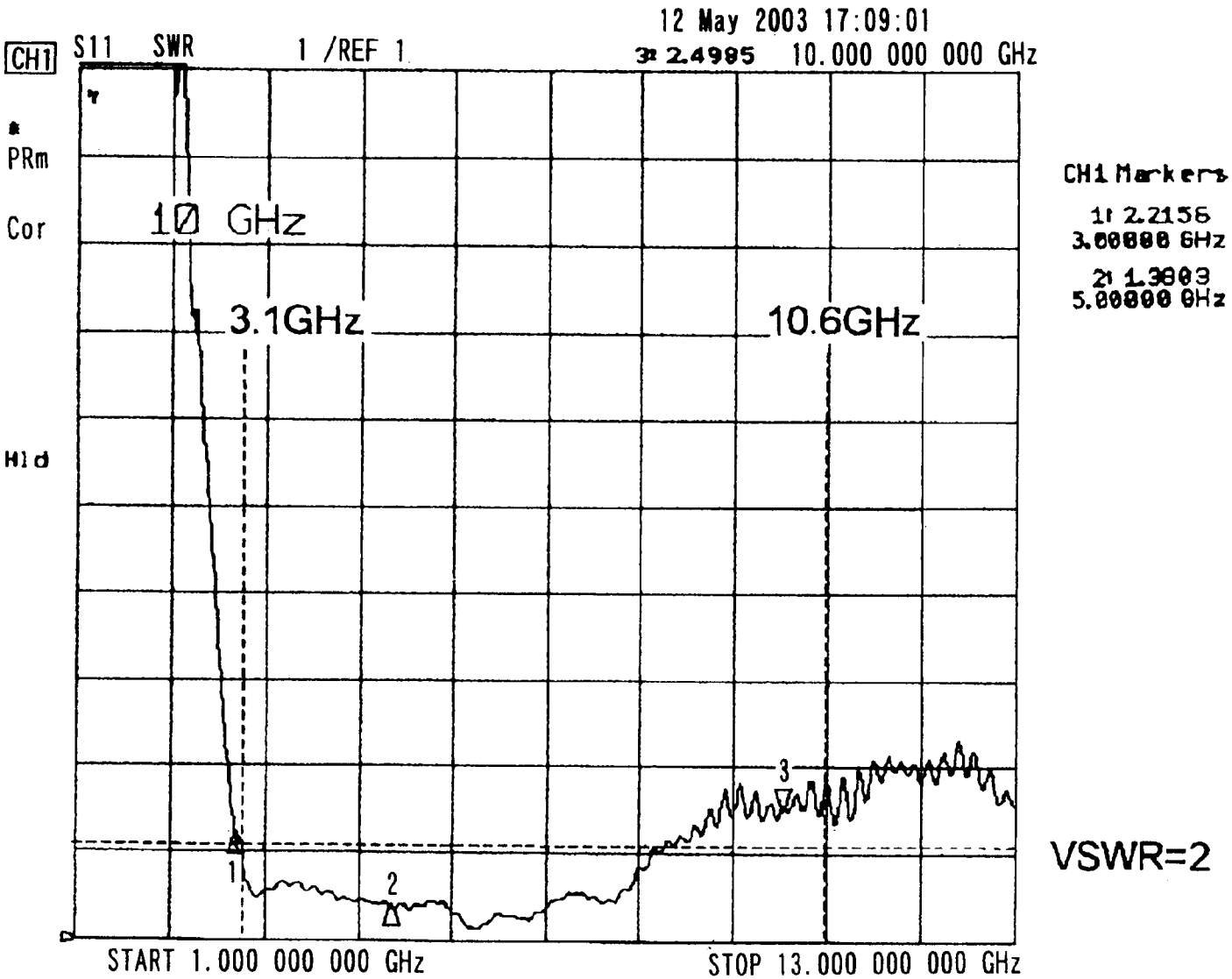
FIG. 3 is a chart showing an example of a result of a measurement of a VSWR of the antenna of the invention.

The result of a measurement of the voltage standing wave ratio (abbreviated as VSWR) regarding the antenna 10 of the invention obtained in this manner is shown by a chart in FIG. 3. In FIG. 3, the horizontal axis is frequency (unit: GHz), and the vertical axis is VSWR (unit: arbitrary), and it was confirmed from the result shown in FIG. 3 that VSWR was approximately 2 or less in the range of 3.1 GHz to 10.6 GHz and the antenna was capable of transmission and reception of wide-band radio signals.

Next, the antenna 20 of the invention shown in FIG. 2 was test-manufactured. A glass epoxy substrate 0.8 mm in thickness was used for the substrate 21. The ground electrode 24 was formed in a manner that a horizontal width was 30 mm, a length was 50 mm and thickness was 0.02 mm. A portion opposed in parallel to the long side and the short side adjacent to each other of the radiation electrode 22 and a portion of the ground electrode 24 where the front end of the feeder electrode 23 was placed so as to enter were processed in accordance with the shape shown in FIG. 2. The radiation electrode 22 was produced by, on the surface of an alumina ceramics sinter such that the length 22*a* of the long side was 7 mm, the length 22*b* of the short side was 5 mm and thickness was 1 mm, printing and firing electrically conductive ink whose main component was silver by a screen printing method, and was mounted by the use of solder on a surface mounting auxiliary electrode formed on the substrate 21. Moreover, distances between the adjacent long side and short side of the radiation electrode 22 and the ground electrode 24 opposed in parallel thereto were set to 2 mm, respectively. Then, the feeder electrode 23 was connected to the midway of the long side of the radiation electrode 22 opposed to the ground electrode 24, whereby the antenna 20 of the invention was obtained.

Figure 4:
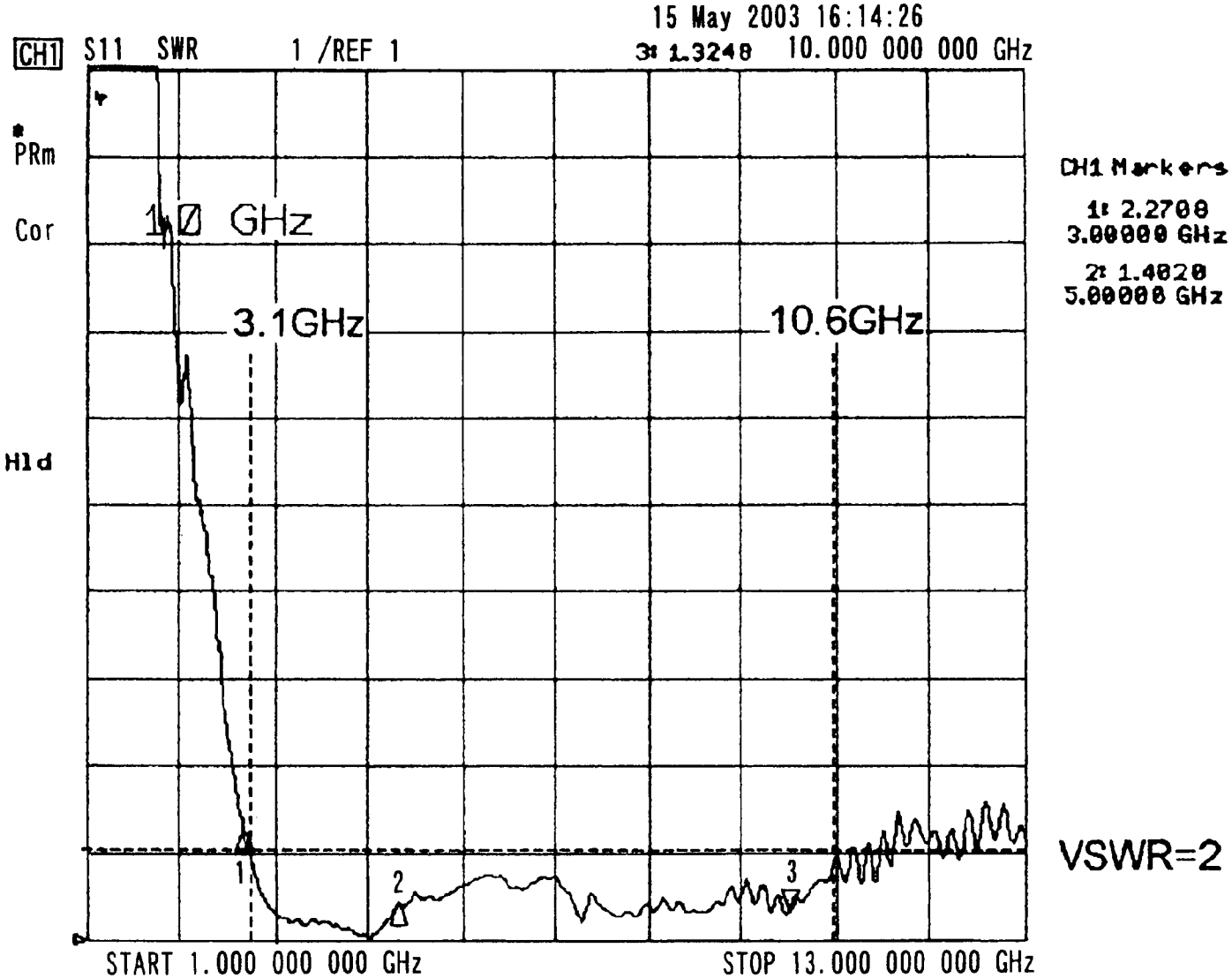
FIG. 4 is a chart showing another example of a result of a measurement of a VSWR of the antenna of the invention.

The result of a measurement of VSWR regarding the antenna 20 of the invention obtained in this manner is shown by a chart in FIG. 4, in the same manner as in FIG. 3. It was confirmed from the result shown in FIG. 4 that VSWR was approximately 2 or less in the range of 3.1 GHz to 10.6 GHz and the antenna was capable of easily transmitting and receiving wide-band radio signals, as in the result shown in FIG. 3.

According to the result shown in FIG. 4, it is known that the bandwidth of the antenna 20 of the invention is slightly wider than the bandwidth of the antenna 10 of the invention shown in FIG. 3. This is considered to be because, in the antenna 20 of the invention, the radiation electrode 12 was made to be thicker than the radiation electrode 12 of the antenna 10 of the invention, whereby the capacity of the radiation electrode 22 became larger and the bandwidth became wider. Therefore, it is apparent that according to the antenna 20 of the invention, when the bandwidth thereof is equal to that of the antenna 10 of the invention, it is possible to make the area of the radiation electrode 22 to be smaller than that of the radiation electrode 12.

Then, when radio communication systems were structured by the use of the antenna 10 and the antenna 20 of the invention as described above and the radio communication apparatuses, excellent radio communication using wide-band signals of 3.1 GHz to 10.6 GHz as radio signals was possible.

The invention is not restricted to the embodiments described above, and can be changed in various manners within the scope of the invention. For example, although a high-frequency and wide-band frequency band of 3.1 GHz to 10.6 GHz is shown in the embodiments described above as an example of frequencies of radio signals such that the antenna and the antenna module of the invention are appropriately used, used frequencies are not limited to the above, and the antenna and the antenna module of the invention show an excellent antenna characteristic to radio signals used in a radio LAN system using a frequency band of 5.2 GHz, for example.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An antenna comprising:

a substrate;

a radiation electrode having a rectangular shape formed on the substrate;

a ground electrode formed on the substrate and opposed in parallel to long and short sides adjacent to each other of the radiation electrode, respectively; and a feeder electrode formed on the substrate and connected to the long side of the radiation electrode, wherein a portion of the ground electrode opposed to the long side has a length not more than the long side and a width equal to or less than the length of the short side, and a portion of the ground electrode opposed to the short side has a length more than the short side and a width equal to or more than the length of the long side.

2. The antenna of claim 1, wherein the feeder electrode is placed in a manner that a front end thereof enters a notch portion formed in the midway of the portion of the ground electrode opposed to the long side.

3. The antenna of claim 1, wherein the substrate is made of a dielectric material and a relative dielectric constant thereof $\epsilon_r$ is in a range of 3 to 30.

4. The antenna of claim 1, wherein the substrate is made of a magnetic material and a relative permeability thereof $\mu_r$ is in a range of 1 to 8.

5. A radio communication apparatus comprising:

the antenna of claim 1; and at least one of a transmitting circuit and a receiving circuit connected thereto.

6. The radio communication apparatus of claim 5, wherein wide-band signals in a range of 3.1 GHz to 10.6 GHz are used as radio signals.

7. An antenna comprising:

a substrate;

a radiation electrode having a rectangular shape formed on the substrate;

a ground electrode formed on the substrate and opposed in parallel to long and short sides adjacent to each other of the radiation electrode, respectively; and a feeder electrode formed on the substrate and connected to the long side of the radiation electrode, wherein a portion of the ground electrode opposed to the long side has a length not more than the long side and a width equal to or less than the length of the short side, and a portion of the ground electrode opposed to the short side has a length more than the short side and a width equal to or more than the length of the long side, wherein the radiation electrode is thicker than the ground electrode.

8. The antenna of claim 7, wherein an internal portion of the radiation electrode is made of a dielectric material and a relative dielectric constant thereof $\epsilon_r$ is in a range of 3 to 30.

9. The antenna of claim 7, wherein an internal portion of the radiation electrode is made of a magnetic material and a relative permeability thereof $\mu_r$ is in a range of 1 to 8.

10. The antenna of claim 7, wherein the feeder electrode is placed in a manner that a front end thereof enters a notch portion formed in a midway of the portion of the ground electrode opposed to the long side.

11. An antenna module comprising:

an antenna comprising a substrate, a radiation electrode having a rectangular shape formed on the substrate, a ground electrode formed on the substrate and opposed in parallel to long and short sides adjacent to each other of the radiation electrode, respectively, and a feeder electrode formed on the substrate and connected to the long side of the radiation electrode, wherein a portion of the ground electrode opposed to the long side has a length not more than the long side and a width equal to or less than the length of the short side, and a portion of the ground electrode opposed to the short side has a length more than the short side and a width equal to or more than the length of the long side;

and an electronic component installed in a region corresponding to the length more than the short side or to the width equal to or more than the length of the long side in the portion opposed to the short side of the ground electrode of the antenna.

12. A radio communication apparatus comprising:

the antenna module of claim 11; and at least one of a transmitting circuit and a receiving circuit connected thereto.

13. The radio communication apparatus of claim 12, wherein wide-band signals in a range of 3.1 GHz to 10.6 GHz are used as radio signals.

* * * * *